US005388359A

United States Patent [19]

DeWitt

[11] Patent Number: 5,388,359

[45] Date of Patent: Feb. 14, 1995

[54] DISPLAY APPARATUS

[75] Inventor: Dale DeWitt, Ladysmith, Wis.

[73] Assignee: Acrylic Design & Fabricators Inc., Ladysmith, Wis.

[21] Appl. No.: 166,852

[22] Filed: Dec. 15, 1993

[51] Int. Cl.[6] ..... G09F 15/00

[52] U.S. Cl. ..... 40/606; 248/231.7; 403/334; 403/333

[58] Field of Search ..... 40/606, 607; 248/229.3, 248/231.7, 316.2, 214, 231.3, 537, 403/383, 334, 333

[56] References Cited

U.S. PATENT DOCUMENTS 148,061 3/1874 Holden ..... 403/383 X
365,264 6/1887 Levering ..... 248/231.7 X
2,452,301 10/1948 Hester ..... 248/231.7
3,296,725 1/1967 Fenwick ..... 40/606
4,786,025 11/1988 Shuman ..... 40/606

*Primary Examiner*—Kenneth J. Dorner
*Assistant Examiner*—Cassandra Davis
*Attorney, Agent, or Firm*—Roger W. Jensen

[57] ABSTRACT

A display apparatus comprising a U-shaped member having a bore extending through a bight portion along an axis perpendicular thereto where the bore is characterized by having a polysided cross section adapted to coact with a polysided plug having preselected dimensions so that the plug may fit within the bore. The bore and the plug have tapered complementary sides so that a snug fit is provided. The number of sides may be infinite so as to produce a bore having a circular cross section.

7 Claims, 3 Drawing Sheets

FIG. 2
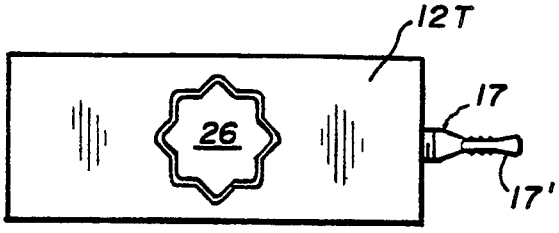
FIG. 3
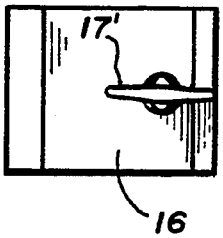
FIG. 4
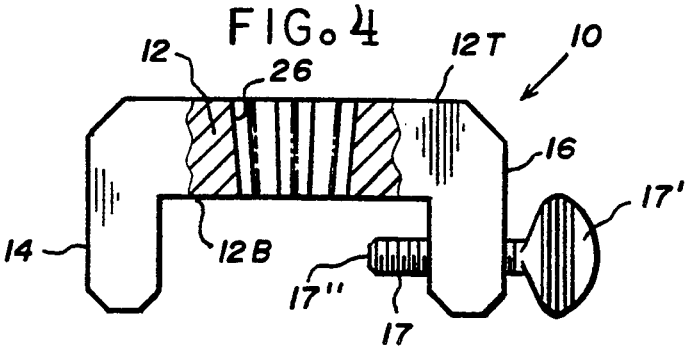
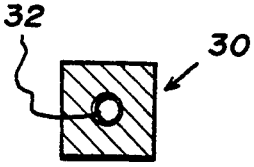
FIG. 5A
FIG. 5
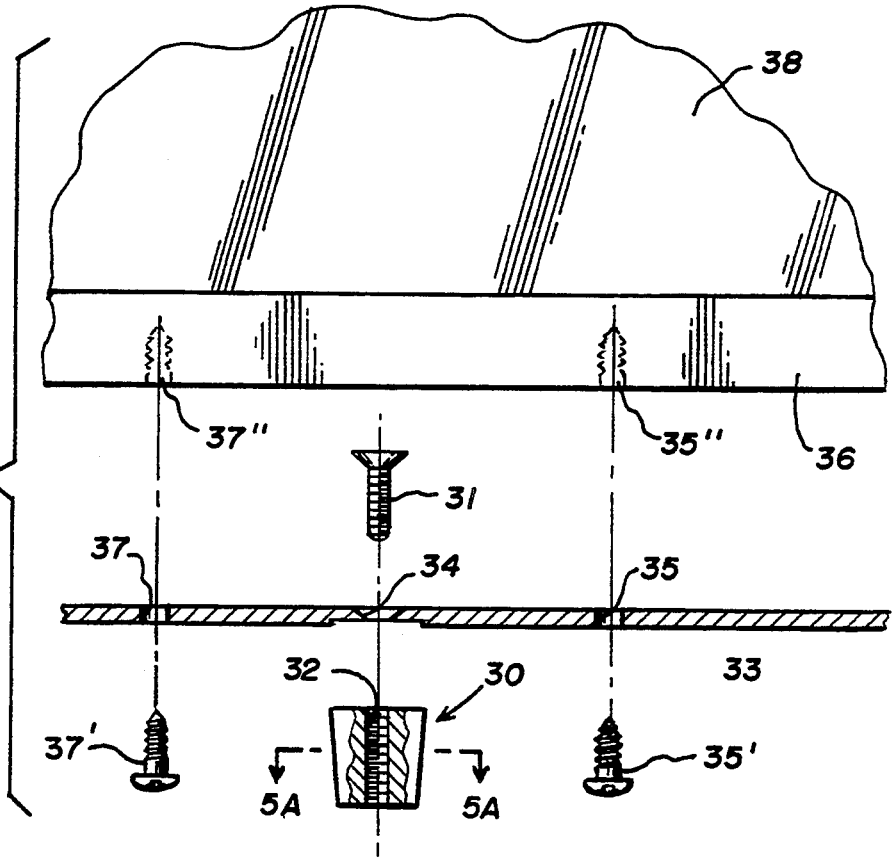

DISPLAY APPARATUS

SUMMARY OF THE INVENTION

This invention is a display apparatus having utility for example in a retail establishment for providing a sign or display for communicating information to customers. As an example the display apparatus may advise pricing information and the like. Broadly speaking of course such display apparatus has been in wide spread use for many years.

My invention provides a display apparatus that may be conveniently attached to the top of a post or to the top surface of a horizontal bar, this attaching means being one of the key facets of my invention. More specifically this is a U-shaped member having a bight portion of a preselected thickness, i.e., the distance between the top side and the bottom side of the bight portion; the member further comprises a pair of side portions extending parallel to one another from opposite ends of the bight portion to thus provide the aforesaid U-shape.

A bore extends through the bight portion along an axis perpendicular thereto, the bore being characterized by having a polysided cross section and by having tapered sides so that the bore has a width or area at the top side larger than the width or area at the bottom side.

A threaded aperture is provided in one of the side portions and positioned therein is a screw means which may be manually adjusted so as to provide a means for holding the U-shaped member to a support means such as the top of a post or to a horizontally extending member.

The invention further comprises a polysided plug having preselected dimensions so that a plug may fit within the bore; the plug is typically integral with a display element such as a sign so that when the plug is fitting within the bore then the sign is held firmly in a preselected position.

In one of the preferred embodiments the polysided bore has eight sides, i.e., an octagon cross section; and the plug has four sides, i.e., a square cross section.

The scope of the invention is not limited to the above mentioned eight sided bore. In fact the teaching of the invention is that the bore could have a circular bore cross section for coacting with a plug that also had a circular cross section; this is the embodiment shown in FIGS. 6–8 and is a preferred embodiment.

DESCRIPTION OF THE DRAWINGS

In the drawings

FIG. 2 shows a top view of the U-shaped member of FIG. 1;

FIG. 3 shows a right side view of the member of FIG. 1;

FIG. 4 shows a side view, partly in section, of the U-shaped member of FIG. 1;

FIG. 5 shows detail associated with the display element including a plug adapted to coact with the member of FIG. 1 and FIG. 5A shows a cross section of the plug as viewed along section lines 5A–5A of FIG. 5;

DETAILED DESCRIPTION OF THE INVENTION

Figure 1:
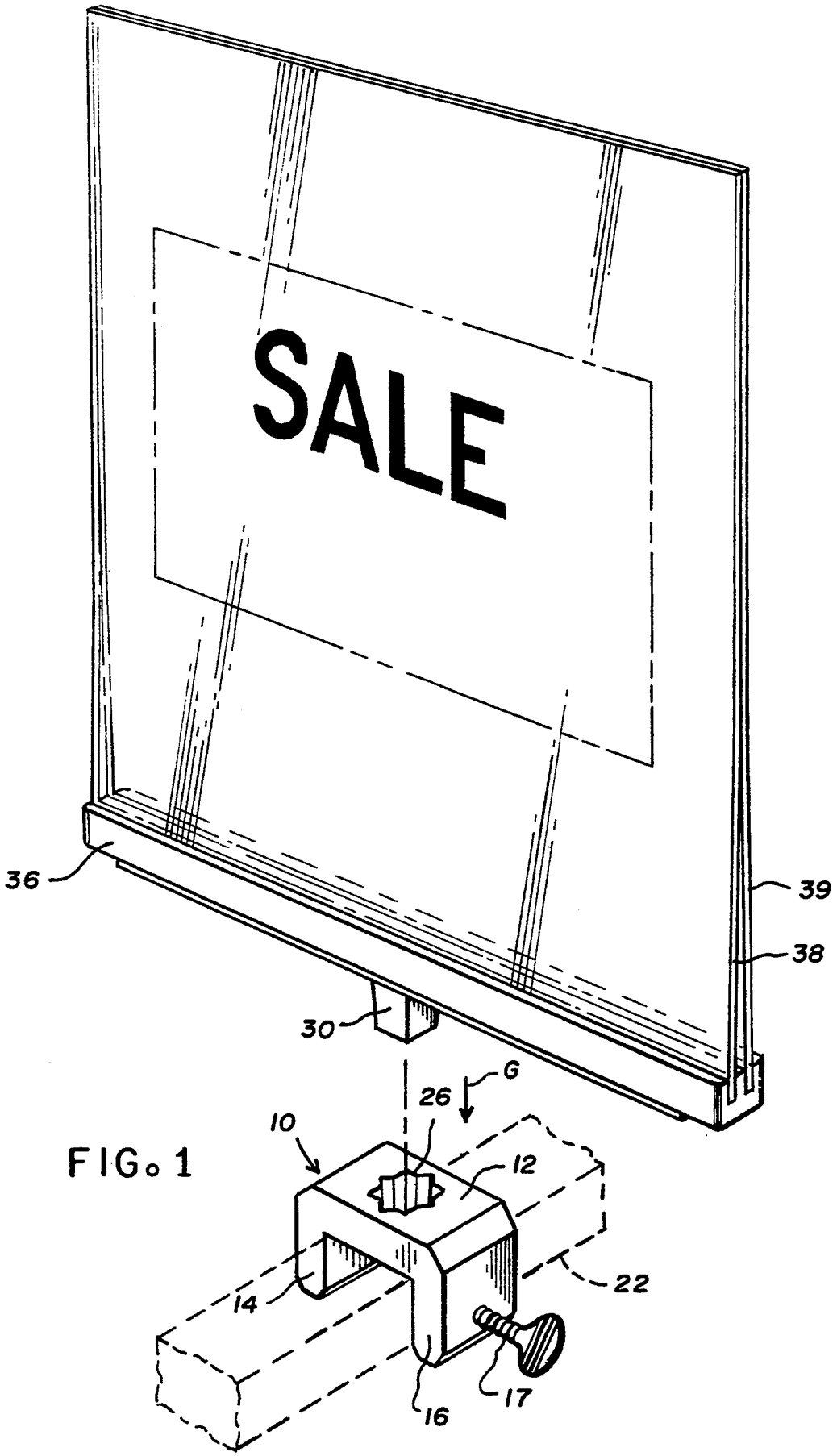
FIG. 1 shows an isometric view of the U-shaped member attached to a horizontal support bar shown in phantom and (by exploded technique) a display element comprising in part a polysided plug; this is one of the preferred embodiments.

In FIG. 1 the U-shaped member is generally designated by reference numeral 10. Referring to FIG. 4 the U-shaped member 10 has a bight portion 12 of a preselected thickness thus defining a top surface 12T and a bottom surface 12B. Depending from each end of the bight portion 12 are a pair of side portions 14 and 16 which extend parallel to one another from opposite ends of said bight portion so as to define the aforesaid "U" shape.

A threaded aperture is provided as side portion 16 so as to receive a screw means 17 which is adjustably positioned along an axis generally perpendicular to the side portion 16 being manually adjustable by suitable means such as the flattened or flanged portion 17' shown in the drawings. The inner end 17 " of the screw means is adapted to abut against a surface of a support means which per se is not part of the invention. More specifically the support means might be a horizontally extending member 22 shown in FIG. 1 or the top of a vertically positioned or oriented post 24 shown in FIG. 6.

The U-shaped member has a bore extending through from the top side 12T to the bottom side 12B along an axis perpendicular to the bight portion. In FIGS. 1, 2 and 4 the bore is identified by reference numeral 26. The bore is characterized first of all by having a polysided cross section shown in one of the preferred embodiments shown in FIGS. 1–5 as an eight sided cross section. The bore is further characterized by having tapered sides so that the bore has a width or area at the top side 12T which is larger than the width or the area of the bore at the bottom side 12B.

The invention further comprises a polysided plug 30 having preselected dimensions so that the plug means may fit within bore 26 and, preferably, has tapered side walls having the same taper as that in the bore 26 so as to provide for a snug fit. Further the polysided plug preferably has one half of the number of sides of the bore. Thus for the embodiment shown in FIGS. 1–5 when the bore is depicted as having eight sides, the plug is depicted as having four sides. This is deafly shown in FIGS. 5 and 5 A.

The plug 30 may be part of a larger display apparatus or display element such as shown in FIGS. 1 and 5. In this embodiment, the plug 30 has a longitudinally extending threaded aperture 32 for receiving a screw means 31 adapted to pass through an aperture 34 in an attaching strip 33 which in turn is adapted to be held by screw means to the bottom side of a holder 36. The screw means 35' and 37' pass through apertures 35 and 37 respectively to be threaded into the bottom part of member 36 as at 35" and 37" respectively. The holder 36 is shown to be holding a pair of transparent members 38 and 39 between which may be positioned information of interest to a customer.

As indicated above the polysided bore 26 preferably has twice the number of sides of the plug. This permits the display element to be oriented in a plurality of angular positions with respect to the U-shaped member. For example and referring to FIG. 1 it will be seen that the plug 30 in addition to the orientation depicted in the drawing may be rotated 45° or 90° either clockwise or counterclockwise about the longitudinal axis to thus provide four different viewing orientations.

Figure 7:
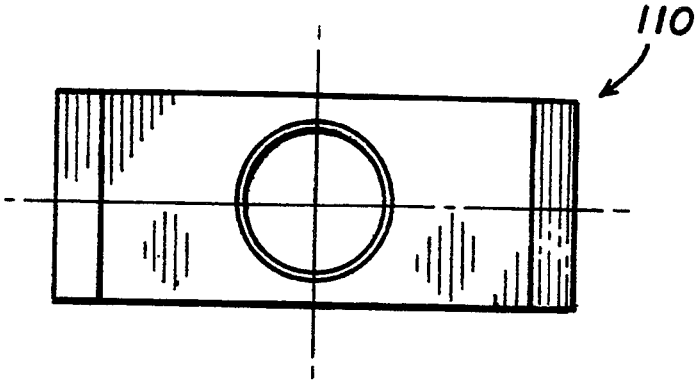
FIG. 7 shows the top view of the member shown in FIG. 6.
Figure 6:
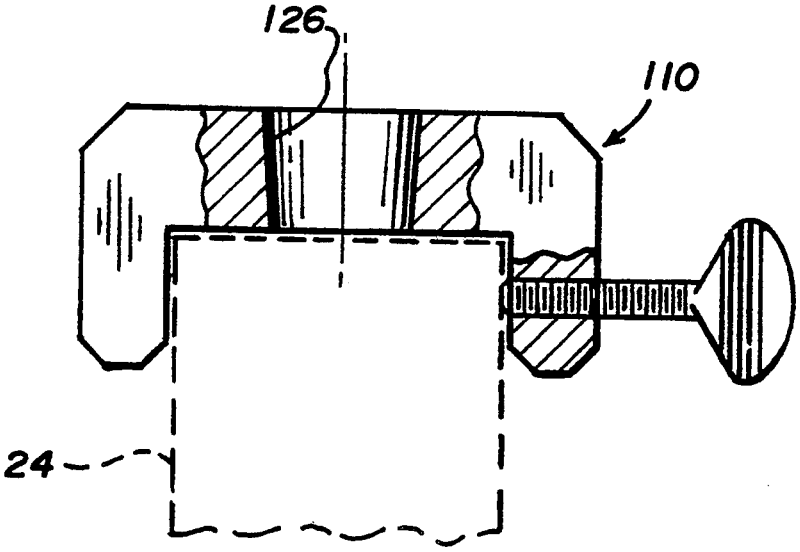
FIG. 6 shows a side view, partly in section, of a U-shaped member of the other preferred embodiment with the member attached to the top of a post.
Figure 8:
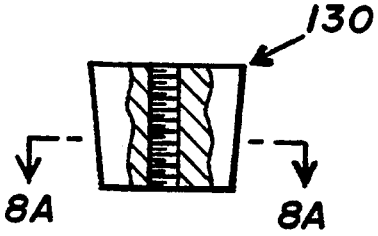
FIG. 8 shows a cross sectional side view of a plug adapted to be used with the member shown in FIG. 6
Figure 8A:
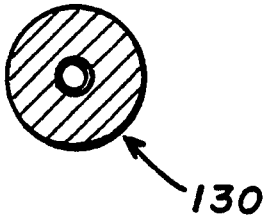
FIG. 8A is a cross section thereof as viewed along section lines 8A–8A.

As further indicated above the number of sides in the polysided bore could have a circular shaped cross section defined by an infinite number of sides and this indeed is one of the preferred embodiments shown in FIGS. 6–8. In these figures the U-shaped member has been designated by reference numeral 110 and the bore by reference numeral 126. In FIG. 8 the modified plug for this embodiment of the invention is designated by reference numeral 130. This embodiment of the invention provides some special advantages. The circular cross section permits a wide selection of orientations of the display with respect to the support means. Further the bore 130 is generally less expensive to machine into the bight portion of the U-shaped member.

For both preferred embodiments, the above described complementary tapers of the bore and the plug has the additional advantage of permitting removal or disconnection of a complete display apparatus from a support means for repositioning thereon or to a separate support means without disassembly of the display apparatus.

I claim:

1. A display apparatus adapted to be mounted on a support means, said display apparatus comprising:

a U-shaped member having a bight portion of a preselected thickness and a pair of side portions extending parallel to one another from opposite ends of said bight portion;

a bore extending through said bight portion from a top side to a bottom side along an axis perpendicular to said bight portion, said bore being characterized by (i) having a polysided cross section, and (ii) having tapered sides so that said bore has a width at said top side larger than a width of said bore at said bottom side;

a threaded aperture in one of said side portions extending there through along an axis generally perpendicular to said one of said side portions;

screw means adjustably positioned in said threaded aperture; and a display element comprising in part a plug having a polysided cross section and having preselected dimensions so that said plug may fit within said bore, whereby said U-shaped member may be mounted on top of said support means and secured thereto by said screw means, and whereby said display element may be positioned in a plurality of preselected angular positions about said bore axis said plug within said bore.

2. Apparatus of claim 1 further characterized by said bore having eight sides and said plug having four sides.

3. Apparatus of claim 1 further characterized by said bore having a circular cross section.

4. Apparatus of claim 3 further characterized by said plug having a circular cross section.

5. Apparatus of claim 1 further characterized by said U-shaped member having said pair of side portions spaced apart a preselected distance so as to facilitate said member being mounted on said support means with said pair of side portions being disposed on opposite sides of said support means.

6. Apparatus of claim 1 further characterized by the number of sides of said bore being twice the number of sides of said plug.

7. Apparatus of claim 1 further characterized by the polysided plug having a preselected taper adapted to facilitate a snug fit of said plug within the tapered sides of said bore.

* * * * *